US006592058B2

(12) United States Patent
Kassanits

(10) Patent No.: US 6,592,058 B2
(45) Date of Patent: Jul. 15, 2003

(54) SPRAY NOZZLE WITH IMPROVED ASYMMETRICAL FLUID DISCHARGE DISTRIBUTION

(75) Inventor: Richard Kassanits, West Chicago, IL (US)

(73) Assignee: Spraying Systems Co., Wheaton, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/491,344

(22) Filed: Jan. 26, 2000

(65) Prior Publication Data

US 2002/0053613 A1 May 9, 2002

(51) Int. Cl.[7] ..... B05B 1/00

(52) U.S. Cl. ..... 239/597; 239/598; 239/599; 239/601

(58) Field of Search ..... 239/597, 598, 239/599, 601; 137/802

(56) References Cited

U.S. PATENT DOCUMENTS 2,619,388 A * 11/1952 Wahlin
2,683,626 A * 7/1954 Wahlin
2,774,631 A * 12/1956 Wahlin
2,778,687 A * 1/1957 Hegstad
2,778,688 A * 1/1957 Corl
2,964,248 A * 12/1960 O'Brien et al.
2,971,250 A * 2/1961 Wahlin
3,697,313 A 10/1972 Stumphauzer et al.
3,737,108 A 6/1973 Stumphauzer et al.
3,843,055 A * 10/1974 Nord et al.
4,346,849 A * 8/1982 Rood ..... 239/597

* cited by examiner

*Primary Examiner*—Michael Mar
*Assistant Examiner*—Christopher Kim
(74) *Attorney, Agent, or Firm*—Leydig, Voit & Mayer, Ltd.

(57) ABSTRACT

A spray nozzle for producing an asymmetrically distributed fluid discharge pattern such as for use in a container coating application is provided. The spray nozzles includes a body portion having an internal fluid passageway which terminates in a substantially hemispherical dome shaped end wall. A discharge orifice is provided in the end wall which is produced by superimposing on each other an approximately round opening and an elongated opening having opposed rounded ends. The elongated opening having a length greater than a diameter of the round opening and the round opening and the elongated opening defining respective edges of the discharge orifice which extend at different angles relative to a longitudinal axis of the fluid passageway. The resulting orifice produces a fluid discharge pattern wherein the amount of fluid discharged tapers in a continuous, non-linear manner from the location of maximum discharge to points of minimum flow at either end of the discharge pattern.

8 Claims, 5 Drawing Sheets

SPRAY NOZZLE WITH IMPROVED ASYMMETRICAL FLUID DISCHARGE DISTRIBUTION

FIELD OF THE INVENTION

The present invention relates to spray nozzles and, more particularly to a spray nozzle, such as for use in container coating applications, which produces an improved asymmetrical distribution of the fluid discharge.

BACKGROUND OF THE INVENTION

In order to protect substances such as food and beverages from contamination, a coating is typically applied to the inside surfaces of containers in which such substances are stored. This coating prevents the contents of the container from coming into direct contact with the bare metal or plastic interior surfaces of the container. With standard cylindrical containers or cans, this coating is generally applied to the interior of the container before the top is affixed through the use of a spray nozzle which is arranged to discharge through the open end of the container. As the coating is being discharged from the nozzle, the container is rotated about its longitudinal axis so as to ensure that all of the interior surfaces are coated.

The coating material used on the inside surfaces of the containers represents one of the most significant costs associated with a container manufacturing operation. Accordingly, in order to minimize consumption of the coating material, it is desirable to utilize a spray nozzle which produces a tightly controlled spray pattern which applies a thin, even coating on the interior surfaces of the container while minimizing the amount of spray that does not contact the interior of the container. Additionally, since the containers can have a wide variety of sizes it is also desirable that the spray nozzles be easily customized to provide a tightly controlled pattern for a particular container configuration.

To help achieve an even coating, the coating material is generally applied using spray nozzles that are configured to produce an asymmetrical distribution of the fluid discharge. These nozzles are arranged at an angle relative to the longitudinal axis of the container so that the heaviest portion of the discharge is directed towards the far, closed end of the container. Thus, the asymmetrical distribution helps compensate for the greater distance the coating material must travel to reach the closed end of the container and, in turn, the greater surface area of the interior of the container that this portion of the discharge pattern must cover.

One common method by which to measure the distribution of the fluid discharge of a particular nozzle is to discharge the nozzle onto what is referred to as a distribution table. The distribution table has on its upper surface a plurality of evenly spaced troughs that have relatively sharp edges which divide the spray into segments and then channel the liquid sprayed into them into test tubes or graduated cylinders for measurement. The spray nozzle is generally oriented relative to the distribution table so that the spray nozzle points downward towards the table with the centerline of the orifice being perpendicular to the surface of the table. The nozzle is centered on one trough and is located at some predetermined distance above the table. For nozzles which produce a flat, fan type spray pattern, including those typically used in container coating applications, the nozzle is arranged so that the widest portion of the fan extends perpendicularly relative to the troughs.

With the asymmetrical pattern spray nozzles presently used in container coating applications, it has been difficult to achieve a thin, even coating on the interior of the containers which avoids waste of the coating material. For example, one type of nozzle which can produce an asymmetrical spray pattern is what is referred to as a drumhead nozzle. A drumhead type nozzle has a discharge orifice configured to produce a fan-shaped discharge pattern with a maximum amount of fluid being discharged at one end of the fan and with the amount of fluid decreasing linearly to a minimum amount at the other end of the fan. With this type of distribution pattern, however, drumhead type nozzles cannot produce a thin, even coating along the bottom of the container and at the intersection between the bottom and the cylindrical side wall of the container. Accordingly, to ensure that all of these surfaces are adequately coated, extra coating material must be applied and, as a result, deposits of excess coating material form in some areas.

Another spray nozzle configuration which can be used in container coating applications is described in U.S. Pat. Nos. 3,697,313 and 3,737,108. In contrast to the drumhead type nozzle which has the maximum discharge at or closely adjacent one end of the spray fan, this type of nozzle produces a discharge pattern where the heaviest discharge or flow of fluid is produced at a point approximately midway between the middle and one end of the total fan-shaped pattern produced by the nozzle. With this type of nozzle, the level or amount of discharge tapers linearly from the location of maximum discharge to either end of the spray pattern. The discharge orifice in the nozzle is produced by making two separate cuts in a dome-shaped end of a cylindrical blank nozzle body using sharply pointed rotary cutting wheels. The resulting orifice has sharply pointed ends and expands to a maximum opening that is arranged asymmetrically between the sharply pointed ends of the orifice.

However, like the drumhead type nozzles, this type of nozzle cannot apply a thin, even coat on the all of the interior surfaces of the container resulting in inefficient consumption of the coating material, which, in turn, results in increased manufacturing costs for the containers.

OBJECTS AND SUMMARY OF THE INVENTION

Accordingly, in view of the foregoing, it is a general object of the present invention to provide a spray nozzle, such as for use in container coating applications, which produces an improved asymmetrical distribution of the fluid discharge.

A more specific object of the present invention is to provide a spray nozzle for use in container coating applications which produces a tightly controlled fluid discharge pattern so as to be able to apply a thin, even coat on the interior surfaces of a container thereby optimizing consumption of the coating material.

A related object of the present invention is to provide a spray nozzle as characterized above which can be easily customized for use with containers having different configurations.

These and other features and advantages of the invention will be more readily apparent upon reading the following description of a preferred exemplary embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
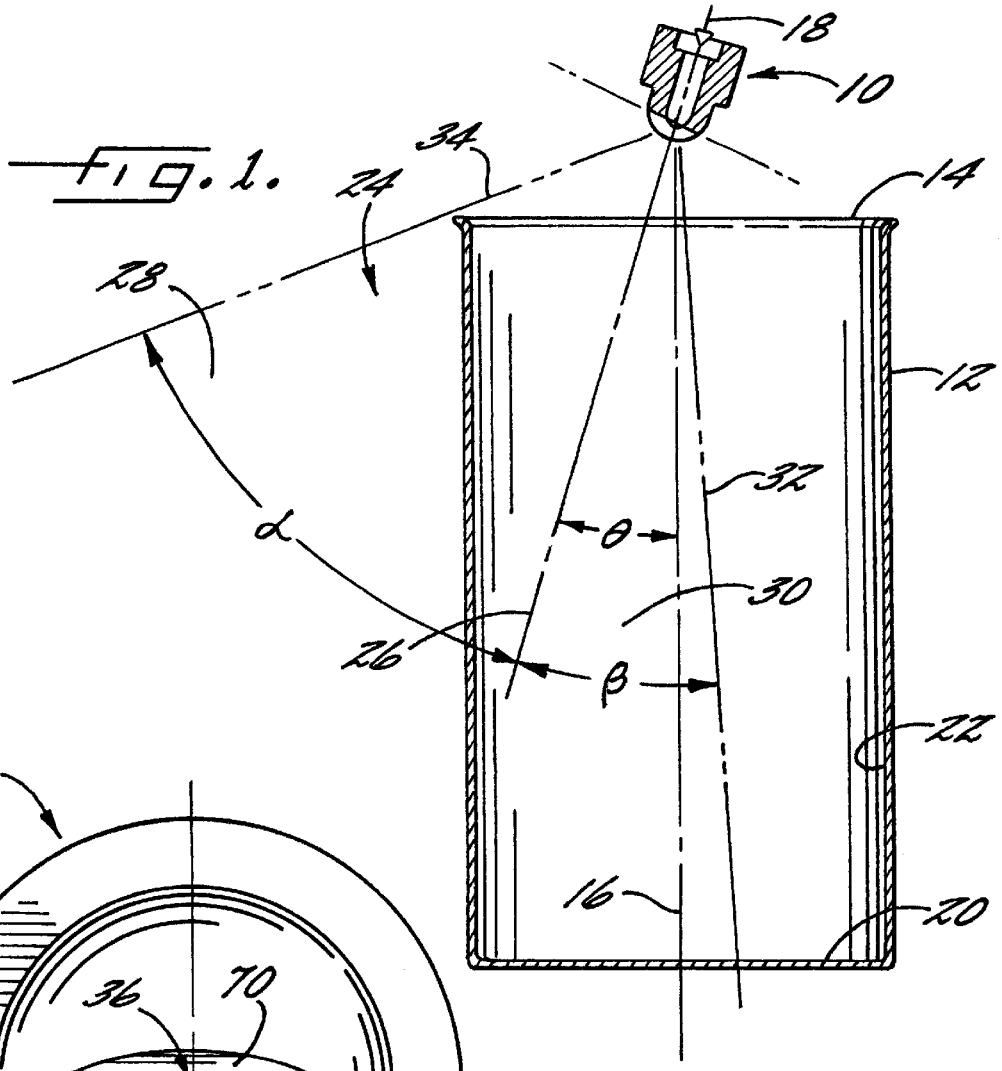
FIG. 1 is a schematic longitudinal section view of a container coating station incorporating an illustrative spray nozzle for producing an asymmetrically distributed fluid discharge pattern which incorporates the features of the present invention.
Figure 2:
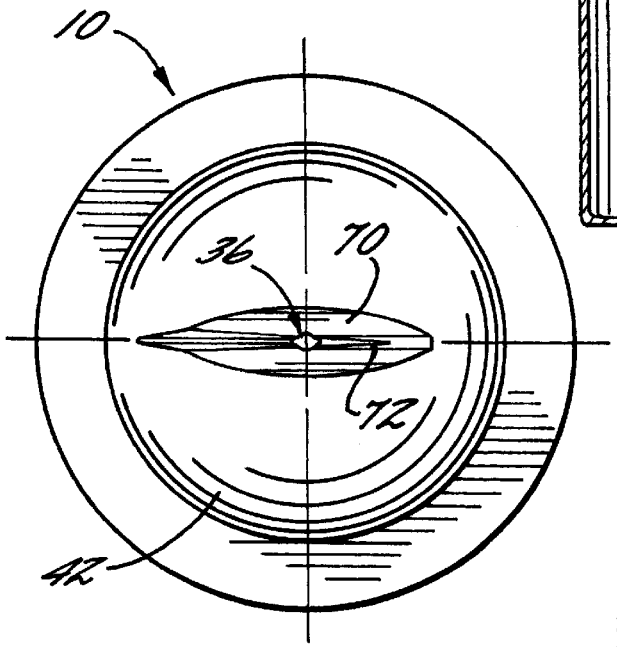
FIG. 2 is a top plan view of the illustrative spray nozzle assembly.
Figure 3:
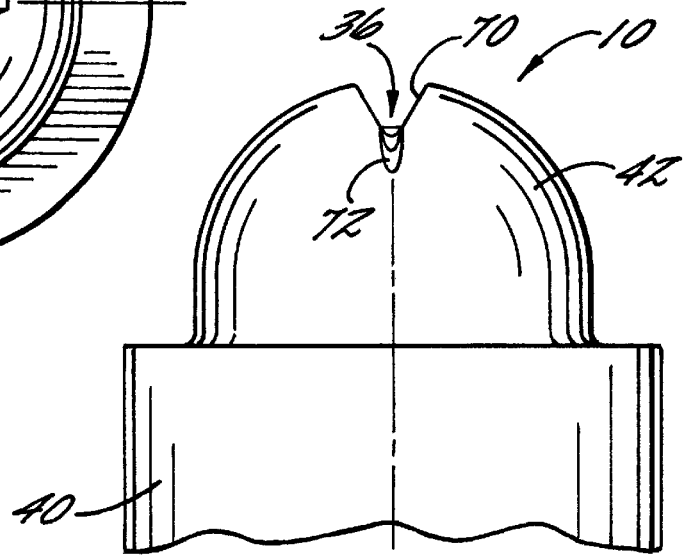
FIG. 3 is a side elevation view of the illustrative spray nozzle assembly.

Referring now more particularly to FIG. 1, there is schematically shown, a portion of an exemplary container coating station that includes a spray nozzle 10 embodying the present invention which discharges, in this case, a coating material fluid in an asymmetrically distributed pattern. More specifically, the spray nozzle 10 is configured so as to produce a flat fan shaped pattern in which the heaviest discharge is shifted from the center towards one end of the fan pattern. With the illustrated container coating station, open-ended containers 12 are indexed one-by-one to the coating station where the stationary spray nozzle 10 applies a coating material onto the interior surfaces of the container 12 through the open end 14. The coating material may comprise vinyl, epoxy, acrylic or other suitable materials. As the coating material is being applied, the container 12 is rotated about its longitudinal axis 16 relative to the spray nozzle 10 at a relatively high speed (e.g., 500–3000 rpm) so that the coating material is applied to the entire interior of the container. As will be understood by those skilled in the art, while the spray nozzle of the present invention is described in connection with a container coating application, it may be employed in other applications and systems where a asymmetrical fluid discharge pattern is desired.

To facilitate application of the coating material, the spray nozzle 10 is disposed on the longitudinal axis 16 of the container 12 a short distance from the open end 14 of the container as shown in FIG. 1. Additionally, the spray nozzle 10 is canted such that the centerline 18 of the nozzle is disposed at an angle θ relative to the longitudinal axis 16 of the container, which, in this case, is oriented substantially horizontal. As explained in greater detail below, to compensate for the greater distance the coating material must travel to reach the closed end of the container 12, the spray nozzle 10 is arranged so that the portion of the spray pattern with the heaviest discharge is directed generally towards the intersection of the bottom wall 20 and cylindrical side wall 22 of the container. As will be appreciated by those skilled in the art, the angle θ of the spray nozzle 10 relative to the longitudinal axis 16 of the container can vary depending on the configuration of the container 12 being coated. In most instances, however, the spray nozzle 10 is preferably arranged at an angle θ of approximately 5° to 20° relative to the longitudinal axis 16 of the container.

In accordance with one important aspect of the present invention, the spray nozzle 10 is configured so as to produce an improved asymmetrical distribution of the fluid discharge as compared to prior art nozzles used for container coating. In particular, prior art nozzles used in container coating applications are configured to produce a discharge pattern in which the amount of discharge tapers linearly from the location of maximum discharge to either end of the spray pattern. It has been found, however, that a linear taper of the distribution amount results in an excess amount of coating material being applied to the sides of the interior of the container. In contrast, the spray nozzle 10 of the present invention has a discharge orifice which is configured to produce a tightly controlled asymmetrical fluid discharge distribution in which the amount of fluid distributed to either side of the area of maximum flow is less than with prior art nozzles. Thus, with the spray nozzle 10 of the present invention, the amount of flow tapers continuously in a non-linear manner from the area of maximum flow to the points of minimum flow at either end of the spray pattern. As a result, the spray nozzle 10 is capable of applying a thin, even coat of a coating material on the interior surfaces of the container 12. Accordingly, the spray nozzle 10 optimizes consumption of the coating material resulting in a significant reduction in the costs associated with manufacturing containers.

Figure 5:
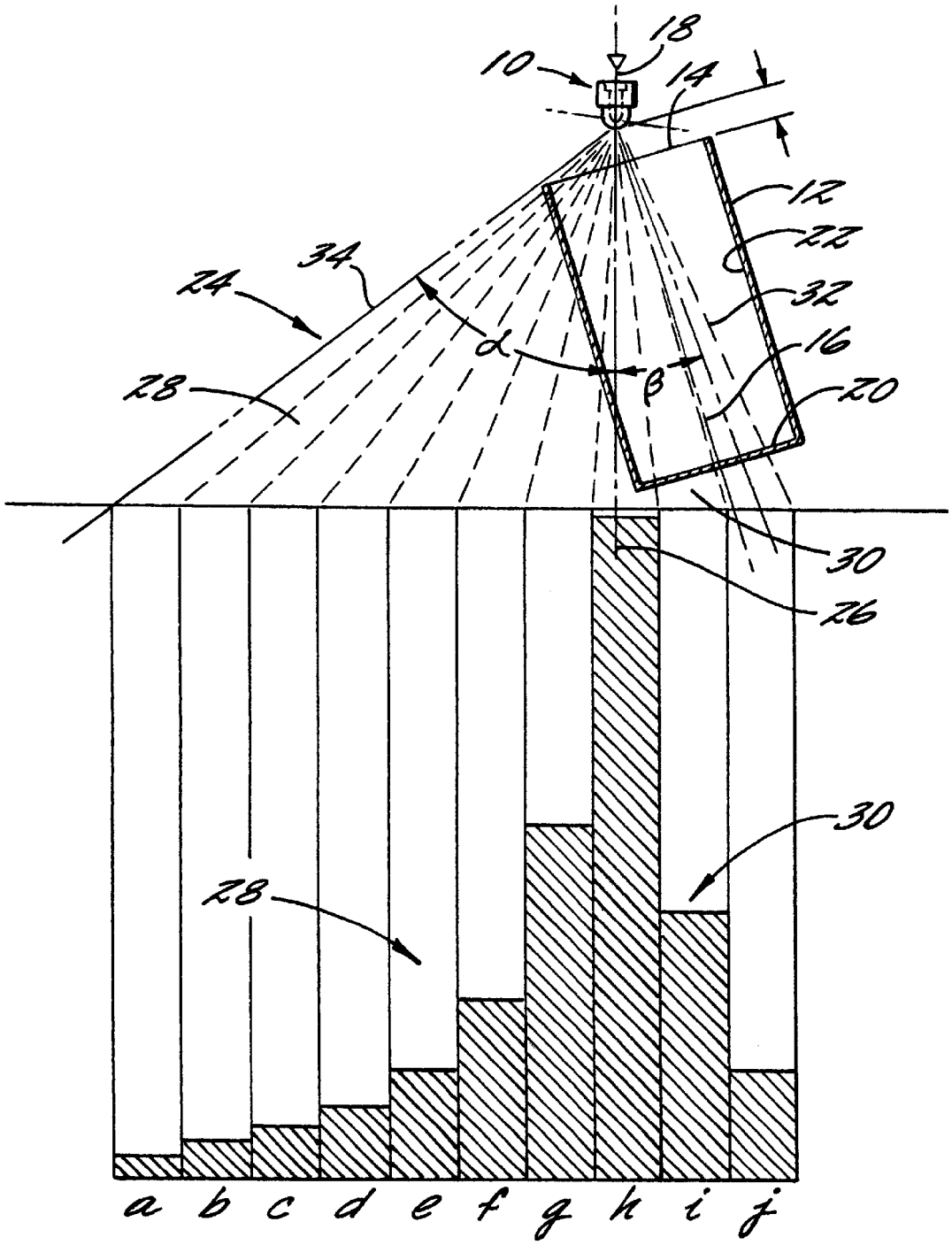
FIG. 5 is a schematic drawing illustrating a desired fluid distribution pattern for the illustrative spray nozzle assembly when utilized in a container coating application.

To this end, a preferred optimal distribution pattern 24 for the spray nozzle 10 is schematically shown in FIG. 5. In FIG. 5, the amount of flow at different points in the spray pattern or fan 24 is illustrated by the shaded areas in the troughs a–j. With this distribution pattern 24, the maximum amount of fluid is discharged at a point (trough h in the illustrated embodiment) approximately midway from the center and one end of the fan thereby dividing the discharge pattern into a larger portion 28 and a smaller portion 30. From the point of maximum discharge, the amount of fluid discharged tapers in a non-linear manner to minimum discharge points at either end of the spray fan 24 (trough a and trough j in FIG. 5). The amount of fluid that is discharged in each of the troughs is directly proportional to the surface area of the portion of the container 12 that is intended to be covered by that portion of the spray fan 24. In FIG. 5, the segment of the interior surface of the container 12 that corresponds to each of the troughs is shown by the broken line extensions of the trough walls back to the discharge orifice of the spray nozzle 10. Thus, when a spray nozzle configured to produce the distribution pattern 24 shown in FIG. 5 is oriented properly with respect to the container 10, an even coat of the sprayed material is produced on the entire interior surface of the container. As will be appreciated from FIG. 5, the additional coating material which is discharged in troughs a–g so as to produce the linear rise to the point of maximum discharge found in the prior art container coating nozzles results in a significant amount of excess coating material being applied to-the side wall of the container.

To ensure an even coat and avoid wasted spray, the spray nozzle 10 is preferably oriented with regard to the container such that the edge 32 of the smaller portion 30 of the spray fan 24 is directed at a point slightly beyond the center of the bottom wall 20 of the container and the edge 34 of the larger portion 28 of the spray fan is directed at the edge of the open end 14 of the container 12, as shown in FIGS. 1 and 5. In particular, any portion of the spray fan 24 which extends beyond the edge of the open end 14 of the container 10 does not contact the container and is therefore wasted. Likewise, any portion of the spray fan 24 which extends beyond the center of the bottom wall 20 of the container 12 is sprayed in excess. The spray nozzle 10 is also preferably oriented so that the portion of the spray fan 24 having the heaviest discharge (referenced by the line 26), which in the illustrated embodiment also coincides with the centerline 18 of the spray nozzle 10, is directed towards the lower portion of the side wall 22 of the container 12 adjacent the intersection of the bottom and side walls 20, 22 of the container as shown in FIG. 5. For ease of reference, in FIGS. 1 and 5, the position of the outer edge 34 of the larger portion 28 of the spray fan 24 relative to the point of heaviest discharge (line 26) is represented by angle $\alpha$ and the position of the outer edge 32 of the smaller portion 30 of the spray fan relative to the point of the heaviest discharge is represented by the angle $\beta$.

Figure 4:
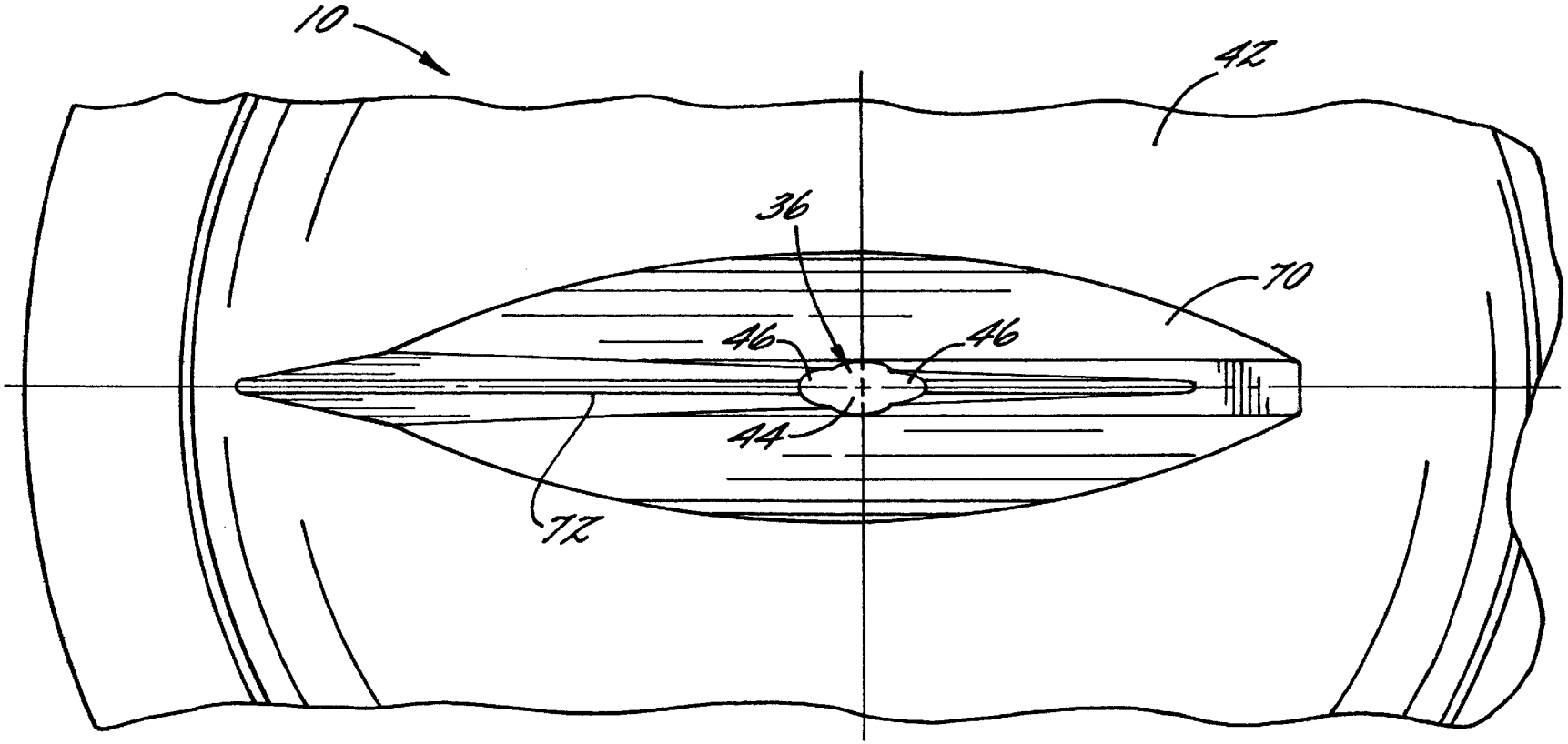
FIG. 4 is an enlarged top plan view of the discharge orifice of the illustrative spray nozzle assembly.
Figure 6:
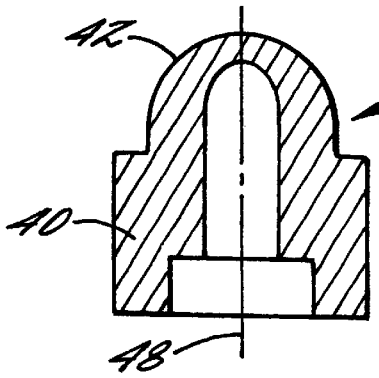
FIG. 6 is a cutaway side elevation view of an illustrative nozzle blank for use in producing the illustrative spray nozzle assembly.

In carrying out the invention, to produce a spray pattern having the desired asymmetrical distribution of the fluid discharge and the desired configuration (e.g., desired angles $\alpha$ and $\beta$), the spray nozzle includes a discharge orifice 36 which is produced by performing, in this case, two separate cutting operations on a nozzle blank 38 having a cylindrical side wall 40 and a dome shaped end wall 42 (shown in FIG. 6). As shown in FIG. 4, these cutting operations yield a discharge orifice 36 comprising an approximately circular or opening and a relatively narrower elongated opening superimposed or overlaid on each other. The resulting discharge orifice 36 has a relatively wider intermediate portion 44 having opposed rounded edges from which extends a pair of relatively narrower opposed notch portions 46 as shown in FIG. 4. The notch portions 46 have respective edges which extend to form ends of the orifice with one of the notch portions being relatively larger than the other as shown in FIG. 4 (as will be appreciated, when enlarged and viewed from above as in FIG. 4 the ends of notch portions appear rounded because the cutter is not perfectly sharp and the nozzle material is not perfectly cuttable). As will be appreciated by those skilled in the art, the present invention is not limited to spray nozzles which produce the exact discharge pattern shown in FIG. 5. Instead, all that is necessary to improve upon the performance of the prior art nozzles is to configure the spray nozzle 10 such that the discharge levels on either side of the area of maximum discharge are lowered to the point that the discharge levels taper in a non-linear manner to the points of minimum flow at either end of the spray fan 24.

Each of the two cutting operations are centered on and performed in the same plane as the longitudinal axis 48 of the nozzle blank 38. The two cutting operations, however, are performed using cutting implements having different cross-sectional profiles and extend through the blank 38 at different angles relative to the longitudinal axis 48 of the nozzle blank. For ease of reference, the two cutting operations will be referred to as first and second cutting operations. However, it will be appreciated that the cutting operations can be performed in any order. In the illustrated embodiment, the cutting operations are performed using rotary cutting wheels having peripheral cutting edges that can be diamond charged or made of carbon for use in electric discharge machines. The cutting operations can be performed either by plunging the wheel into the nozzle blank 38 or by cutting across the nozzle blank.

Figure 7:
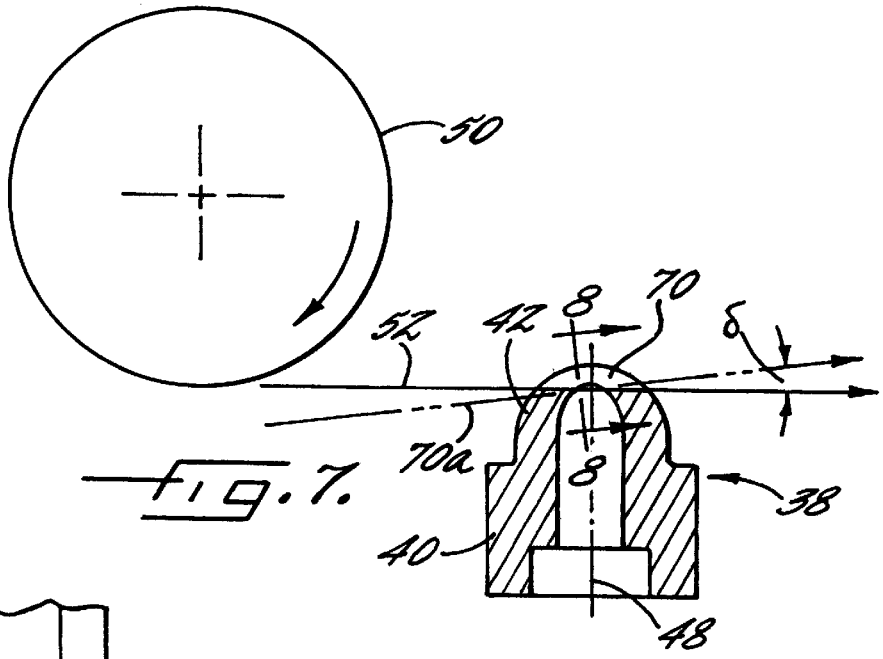
FIG. 7 is a schematic side elevation view showing a cutting path for a first cut used to produce the discharge orifice of the spray nozzle of FIG. 1.
Figure 9:
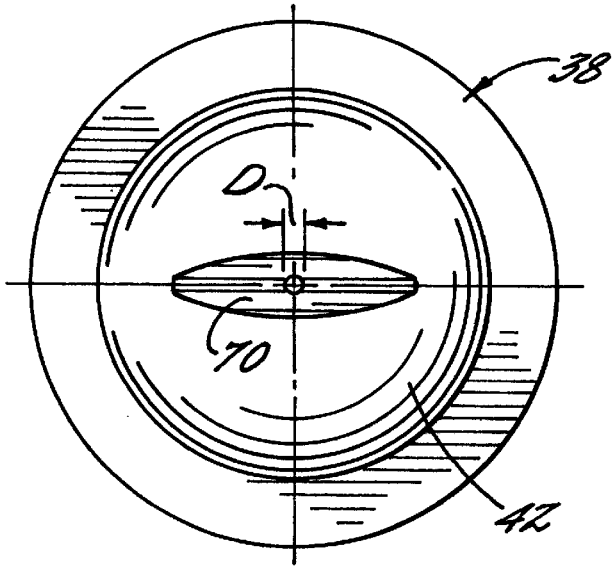
FIG. 9 is a top plan view showing the nozzle blank after completion of the first cut.

For the first cutting operation, a first rotary cutting wheel 50 having a cutting edge 54 configured to produce a substantially circular opening having a diameter D in the dome of the nozzle blank, as shown in FIG. 9, is used. As shown in FIG. 7, the first cutting operation can be executed either in a plane 52 perpendicular to the longitudinal axis 48 of the nozzle blank 38 or at some angle $\delta$ relative to perpendicular. The profile of the cutting edge 54 of the first cutting wheel 50 can be as simple as a straight flat which is used to remove a portion of the top 42 of the nozzle blank 38 at some point above where the domed top of the blank meets the cylindrical side wall 40. However, the use of a straight flat cutting edge in the first cutting operation creates a circular opening having a sharp, thin edge which wears very quickly. Since the sizes of the cuts, and in turn, the size of the resultant discharge orifice 36 are carefully calibrated to produce the desired spray pattern, any wear along the edges of the orifice will lead to a rapid increase in flow through the orifice and a resultant breakdown in the desired spray pattern.

Figure 8:
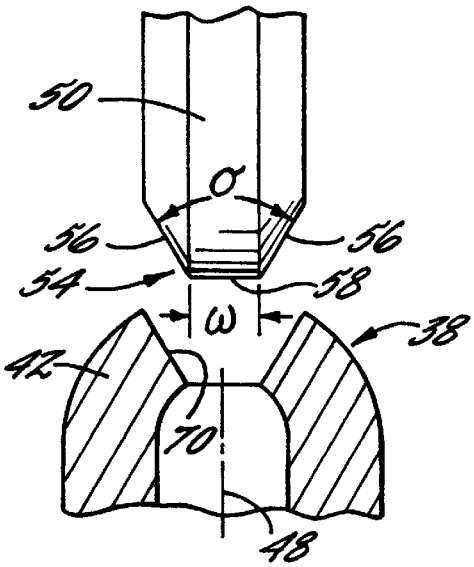
FIG. 8 is an enlarged section, taken in the plane of line 8—8 in FIG. 7, showing the transverse profile of the first cut, as well as the cutting edge of the cutting wheel used to produce the first cut.

According to a further aspect of the present invention, to provide enhanced wear characteristics and therefore increased longevity, the first cut on the nozzle blank 38 is executed in such a manner so as to avoid the formation of any thin edges about the periphery of the orifice. In particular, as opposed to using a straight flat cutting edge profile, the first cutting wheel 50 can be configured with a cutting edge 54 having a profile that includes multiple angled portions. For example, one preferred embodiment of an angled profile cutting edge 54 for the first cutting wheel 50 is shown in FIG. 8. In FIG. 8, the cutting edge 54 has a pair of angled sides 56 (defining an included angle $\sigma$) which extend to a flat tip 58. By matching the size of the width of the tip W of the cutting edge 54 to the desired diameter D of the opening produced by the first cutting operation, the thin, rapidly wearing edges can be minimized.

Figure 10:
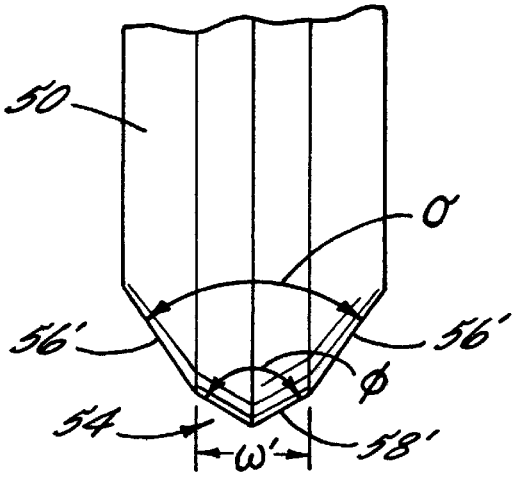
FIG. 10 is an enlarged partial side elevation view of the cutting edge of an alternative embodiment of a cutting wheel for producing the first cut.

Alternatively, as shown in FIG. 10, the first cutting wheel 50 could have a cutting edge 54' having a pair of angled sides 56' which taper to an angled tip 58' that defines an included angle $\phi$ which is greater than the included angle $\sigma$ defined by the angled sides 56'. With the cutting edge profile of FIG. 10, thin edges can be avoided by matching the width W' of the angled tip 58' to the desired diameter D of the opening produced by the first cutting operation. Using an angled tip on the cutting edge, as opposed to the flat tip of FIG. 9, causes the portion of the distribution pattern with the heaviest discharge to broaden. For example, with reference to FIG. 5, using an angled tip on the cutting edge will reduce the difference between the fluid levels in troughs g, h and i.

Figure 11:
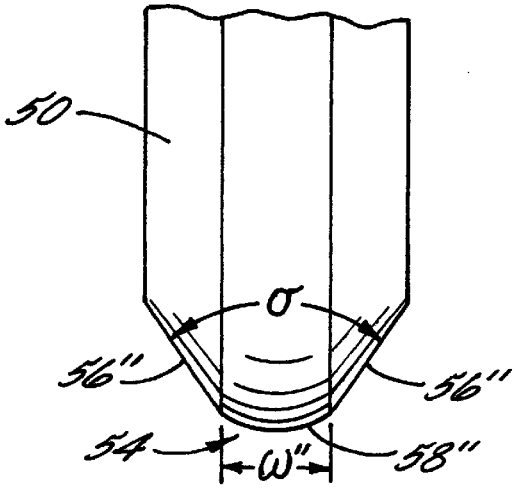
FIG. 11 is an enlarged partial side elevation view of the cutting edge of another embodiment of a cutting wheel for producing the first cut.

In yet another alternative embodiment, the first cutting wheel 50 could have a cutting edge 54" defined by a pair of angled sides 56" which taper to a rounded tip 58" as shown in FIG. 11. Similar to the embodiments of FIGS. 8 and 10, the width W" of the rounded tip 58" is matched to the desired diameter D of the opening produced by the first cutting operation. Likewise, similar to the FIG. 10 embodiment, decreasing the radius of the rounded tip 58" will cause the area of the heaviest discharge in the distribution pattern to broaden.

Figure 12:
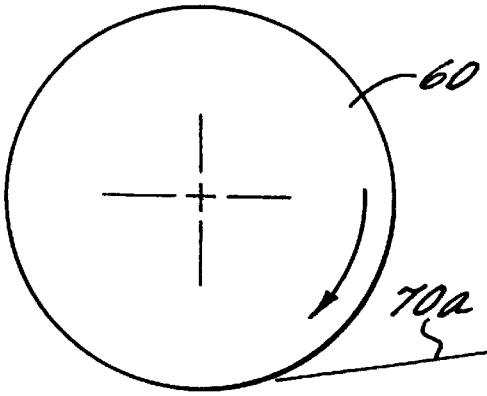
FIG. 12 is a schematic side elevation view showing a cutting path for a second cut used to produce the orifice of the illustrative spray nozzle.
Figure 13:
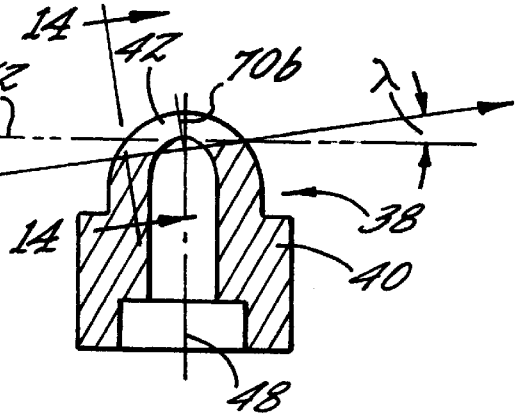
FIG. 13 is an enlarged partial side elevation view of the cutting edge of a cutting wheel for producing the second cut.
Figure 13:
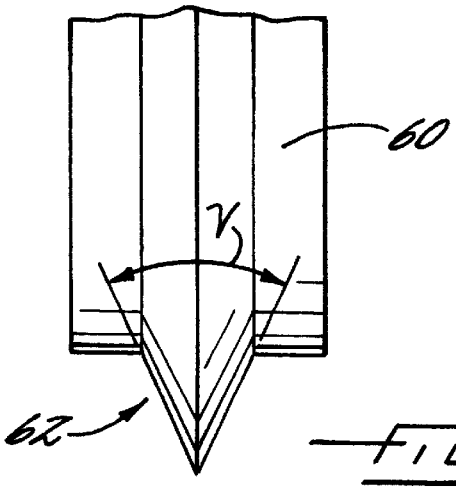
Figure 14:
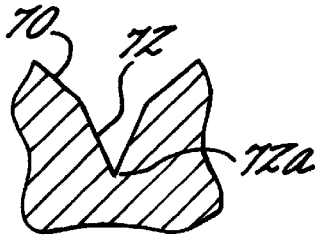
FIG. 14 is a fragmentary section, taken in the plane of line 14—14 in FIG. 12, showing the transverse profile of the second cut produced by the cutting wheel shown in FIG. 13.

For the second cutting operation, a second rotary cutting wheel 60 having a cutting edge 62 which tapers to a sharp point, as shown in FIG. 12, is used. In the illustrated embodiment, the profile of the cutting edge 62 used for the second cut defines an included angle γ which is approximately one half of the included angle defined by the angled sides 56, 56', 56" of the cutting edge used to produce the first cut. As with the first cutting operation, the second cut is centered on the longitudinal axis 48 of the nozzle blank 38. However, the second cut is performed at an angle relative to the plane in which the first cut is performed. In particular, as shown in FIG. 12, the second cut is made at an angle λ relative to the plane 52 which extends perpendicular to the longitudinal axis 48 of the nozzle blank. If the first cut is done on an angle δ relative to the perpendicular, the second cut should be executed so that it is angled, in the same direction relative to perpendicular as the first cut. In such a case, however, the second cut should be at a larger angle than the first cut.

From the foregoing, it can be seen that the discharge orifice 36 effectively is defined by two elongated cross-slots or grooves 70, 72. The first elongated cross-slot 70 has a cross-sectional profile with angled sides defined by the angled sides 56, 56', 56" of the first cutting wheel 50. The second elongated cross-slot 72 has a cross-sectional profile with sharper angled sides defined by the angled sides 62 of the second cutting wheel 60. The first elongated slot 70 has a longitudinal axis 70*a*, as defined by a line perpendicular to a transverse cross-sectional profile of the slot 70, as viewed in FIG. 8, which in the illustrated embodiments correspond to the particular profile 56, 56', 56" of the cutter 50, and which extends at a first angle to the longitudinal axis 48 of the flow passageway. The second elongated slot 72 has a narrower width and a longitudinal axis 72*a*, as defined by a line perpendicular to a cross-sectional profile of that slot 72, extends at a greater angle to a plane perpendicular to the longitudinal axis 48 of the fluid passageway than the longitudinal axis of the first elongated slot 70.

In order to adjust the position of the point (represented by line 26) of heaviest discharge within the spray pattern, the angle δ at which the first cut is performed relative to the plane 52 which extends perpendicular relative to the longitudinal axis 48 of the nozzle blank 38 can be varied. In this way the spray nozzle 10, and in turn the distribution pattern 24, can be configured for containers having different heights. Specifically, as shown in FIG. 7, the first cut can be performed at an angle δ relative to perpendicular in order to shift the heaviest portion (line 26) of the distribution towards the edge 32 of the larger portion 28 of the spray pattern with respect to FIG. 5. By varying the angle δ at which the first cutting operation is performed, the distance that the heaviest portion of the distribution moves can be varied. Thus, in order to configure the spray nozzle 10 for coating a relatively shorter container, the angle δ of the first cut should be increased.

Moreover, the distribution pattern can be further calibrated by adjusting the angle λ at which the second cut is performed as well as by adjusting the included angle γ of the cutting edge 62 used for the second cutting operation. In particular, the relative sizes of the larger and smaller portions 28, 30 of the spray pattern (i.e. angles α and β in FIG. 5) can be adjusted by varying the angle λ at which the second cutting operation is performed. For instance, performing the second cut at a relatively smaller angle λ will increase the size of the smaller portion 30 of the distribution pattern, making the overall pattern less asymmetrical. In addition, with all the other variables held constant, increasing the included angle γ of the cutting edge 62 on the second cutting wheel 60 will increase the angle of the overall spray pattern (i.e. angle α plus angle β in FIG. 5).

From the foregoing, it can be seen that the spray nozzle of the present invention produces an improved asymmetrical distribution of the fluid discharge. This improved distribution enables the nozzle of the present invention to apply a thin, even coat on the interior surfaces of a container and to thereby optimize consumption of the relatively costly coating material. Moreover, the spray nozzle can be readily customized for use in coating containers having different configurations.

All of the references cited herein, including patents, patent applications, and publications, are hereby incorporated in their entireties by reference.

While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and scope of the invention as defined by the following claims.

What is claimed is:

1. A spray nozzle for producing an asymmetrically distributed fluid discharge pattern wherein the location of the maximum fluid discharge is offset from the center of the fluid discharge pattern, the spray nozzle comprising:

a body portion having an internal fluid passageway which terminates in a substantially hemispherical dome shaped end wall, the fluid passageway having a longitudinal passageway axis, and said end wall being formed with a discharge orifice having a longitudinal orifice axis; said discharge orifice having a configuration formed by an approximately round opening and an elongated opening which are superimposed on each other; said elongated opening having opposed ends and a length greater than a diameter of the approximately round opening; said discharge orifice being formed in part by a first elongated slot which extends through the hemispherical dome-shaped end wall; said first elongated slot having a transverse cross-sectional profile with angled sides which define an included angle; said first elongated slot having a longitudinal axis, defined by a line perpendicular to the transverse cross-sectional profile of the slot, which extends at a first angle to the longitudinal axis of the said flow passageway; said discharge orifice further being defined in part by a second elongated slot; said second elongated slot having a transverse cross-sectional profile with sides that define an included angle that is less than the included angle defined by the angled sides of the cross-sectional profile of the first elongated slot; said second elongated slot having a longitudinal axis, defined by a line perpendicular to the transverse cross-sectional profile of the second elongated slot, that extends at a greater angle to a plane perpendicular to the longitudinal axis of said fluid passageway than the longitudinal axis of said first elongated slot;

wherein said discharge orifice is configured to produce a fluid discharge pattern having a continuous non-linear taper in the amount of fluid discharged from the location of maximum discharge to a point of minimum flow at one end of the discharge pattern so as to form a discharge which for a substantial portion thereof represents less fluid discharge than a discharge curve consisting of a line connecting the location of maximum discharge with the point of minimum flow at the one end of the discharge pattern.

2. The spray nozzle of claim 1 in which the cross-sectional profile of said first elongated slot has tapered sides and a flat bottom.

3. The spray nozzle according to claim 1 in which the cross-sectional profile of said second elongated slot has tapered sides which taper to a sharp point.

4. The spray nozzle according to claim 1 in which the cross-sectional profile of said first elongated slot has with tapered sides and a rounded bottom portion.

5. A spray nozzle for producing an asymmetrically distributed fluid discharge pattern wherein the location of the maximum fluid discharge is offset from the center of the fluid discharge pattern, the spray nozzle comprising:

a body portion having an internal fluid passageway which terminates in a substantially hemispherical dome shaped end wall, the fluid passageway having a longitudinal passageway axis, and said end wall being formed with a discharge orifice having a longitudinal orifice axis; said discharge orifice having a configuration defined by an approximately round opening and an elongated opening which are superimposed on each other; the elongated opening having opposed ends and a length greater than a diameter of the approximately round opening; said discharge orifice being formed in part by a first elongated slot which extends through the hemispherical dome-shaped end wall; said first elongated slot having a longitudinal axis, defined by a line perpendicular to a transverse cross-sectional profile of the slot, which extends at a first angle to the longitudinal axis of said flow passageway; said discharge orifice further being formed in part by a second elongated slot; said second elongated slot having a smaller transverse width than said first elongated slot and having a longitudinal axis, defined by a line perpendicular to the cross-sectional profile of the second elongated slot, that extends at a greater angle to a plane perpendicular to the longitudinal axis of said flow passageway than the longitudinal axis of said first elongated slot; and wherein said discharge orifice is configured to product a fluid discharge pattern having a continuous non-linear taper in the amount of fluid discharged from the location of maximum discharge to a point of minimum flow at one end of the discharge pattern so as to form a discharge which for a substantial portion thereof represents less fluid discharge than a discharge curve consisting of a line connecting the location of maximum discharge with the point of minimum flow at the one end of the discharge pattern.

6. The spray nozzle of claim 5 in which the cross-sectional profile of said first elongated slot has tapered sides and a flat bottom.

7. The spray nozzle according to claim 5 in which the cross-sectional profile of said first elongated slot has tapered sides which taper to a sharp point.

8. The spray nozzle according to claim 5 in which the cross-sectional profile of said first elongated slot has tapered sides and a rounded bottom portion.

* * * * *